US007389948B1

(12) United States Patent
Lampman

(10) Patent No.: US 7,389,948 B1
(45) Date of Patent: Jun. 24, 2008

(54) AIRBRUSH SPRAYING DEVICE FOR BEAUTY PRODUCTS

(76) Inventor: George Robert Lampman, 14137 Wyandotte St., Van Nuys, CA (US) 91405

( * ) Notice: Subject to any disclaimer, the term of this patent is extended or adjusted under 35 U.S.C. 154(b) by 580 days.

(21) Appl. No.: 11/082,323

(22) Filed: Mar. 16, 2005

(51) Int. Cl.
*B05B 7/30* (2006.01)
*B05B 7/32* (2006.01)
*B05B 7/14* (2006.01)

(52) U.S. Cl. ..... 239/348; 239/337; 239/340; 239/347; 239/353; 222/637

(58) Field of Classification Search ..... 222/318, 222/630, 637; 239/117, 124, 125, 290, 319, 239/341, 345, 346, 347, 348, 353, 390, 414
See application file for complete search history.

(56) References Cited

U.S. PATENT DOCUMENTS 595,931 A * 12/1897 Wold ..... 239/414
4,685,622 A * 8/1987 Shimohira et al. ..... 239/346
4,961,537 A * 10/1990 Stern ..... 239/348

* cited by examiner

*Primary Examiner*—Thor S. Campbell
*Assistant Examiner*—Ryan Reis
(74) *Attorney, Agent, or Firm*—The Kline Law Firm

(57) ABSTRACT

An airbrush spraying device particularly adapted for the application of beauty products includes a tubular main body that is attached to a pressurized air supply. A control switch is situated on a top side of the airbrush. The control switch is connected to a mechanism that controls an air valve and a position of a makeup flow control mechanism. The air valve is an on/off mechanism, but the makeup flow control mechanism includes adjusting means so that the flow rate of makeup through the airbrush can be controlled by the user. The makeup is supplied to the airbrush from one of a plurality of makeup collars that are affixed to the main body of the airbrush. In order to enable the user to accurately apply the makeup, a mirror and a standoff marker are affixed to a forward end of the airbrush.

20 Claims, 7 Drawing Sheets

AIRBRUSH SPRAYING DEVICE FOR BEAUTY PRODUCTS

BACKGROUND OF THE INVENTION

1. Field of the Invention

The present invention relates generally to an airbrush spraying device, and more particularly is an airbrush adapted to enable the user to self-apply beauty products.

2. Description of the Prior Art

Over the years, it has become standard practice to apply various paints and pigments to a person's body by means of a spraying apparatus commonly referred to as an airbrush. The airbrush is used to accurately spray paints, or some other pigmented material used as a decorative and protective finish with an expectation of extended durability and wear. The beauty products are applied daily or more often for esthetic and therapeutic purposes.

One example of such a device in the prior art is the "Spraying Apparatus" of Ching, U.S. Pat. No. 5,094,400, issued Mar. 10, 1992. The device is connected to a pressurized air supply, and is operated by a sliding thumb switch. The makeup to be applied is contained in a cup mounted on the airbrush body. While this device is an excellent means of applying makeup, it does have several shortcomings.

Further, the Ching device is operated by a switch that is basically on/off. The user cannot easily control of the flow rate of makeup from the device.

Accordingly, it is an object of the present invention to provide a device that has multiple interchangeable makeup supply reservoirs.

It is another object of the present invention to provide a control switch that allows the user to easily adjust the flow rate of makeup from the device.

It is still another object of the present invention to provide a device that can be constructed from dishwasher safe plastic parts, so that the device can be cleaned in a dishwasher.

SUMMARY OF THE INVENTION

The present invention is an airbrush device particularly adapted for the application of beauty products. The airbrush comprises a tubular main body with a pressurized air supply. The air supply is mounted not at the end of the main body, but rather on a bottom side behind a midpoint of the main body due to ergonomic considerations. A thumb operated control switch is situated on a top side of the airbrush. The control switch is connected to a rack and pinion mechanism that controls an air valve and a position of a makeup flow control mechanism. The air valve is an on/off mechanism, but the makeup flow control mechanism includes adjusting means so that the flow rate of makeup through the airbrush can be controlled by the user. The makeup is supplied to the airbrush from one of a plurality of makeup collars that are affixed to the main body of the airbrush.

In order to enable the user to accurately apply the makeup, a mirror and a standoff marker are affixed to a forward end of the airbrush. The attached mirror allows the user to see the area of application without interfering with the travel path of the airbrush. The standoff marker provides a method of keeping the nozzle of the airbrush the proper distance from the user during use.

An advantage of the present invention is that the interchangeable makeup collars provide flexibility in makeup supply, and ease cleanup.

Another advantage of the present invention is that the flow rate of the makeup from the makeup collar is infinitely variable.

A still further advantage of the present invention is that the attached mirror allows the user to see the area of application without requiring two hand operation.

Yet another advantage of the present invention is the standoff marker that is provided allows the user to easily and accurately keep the nozzle of the airbrush the proper distance from the user.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
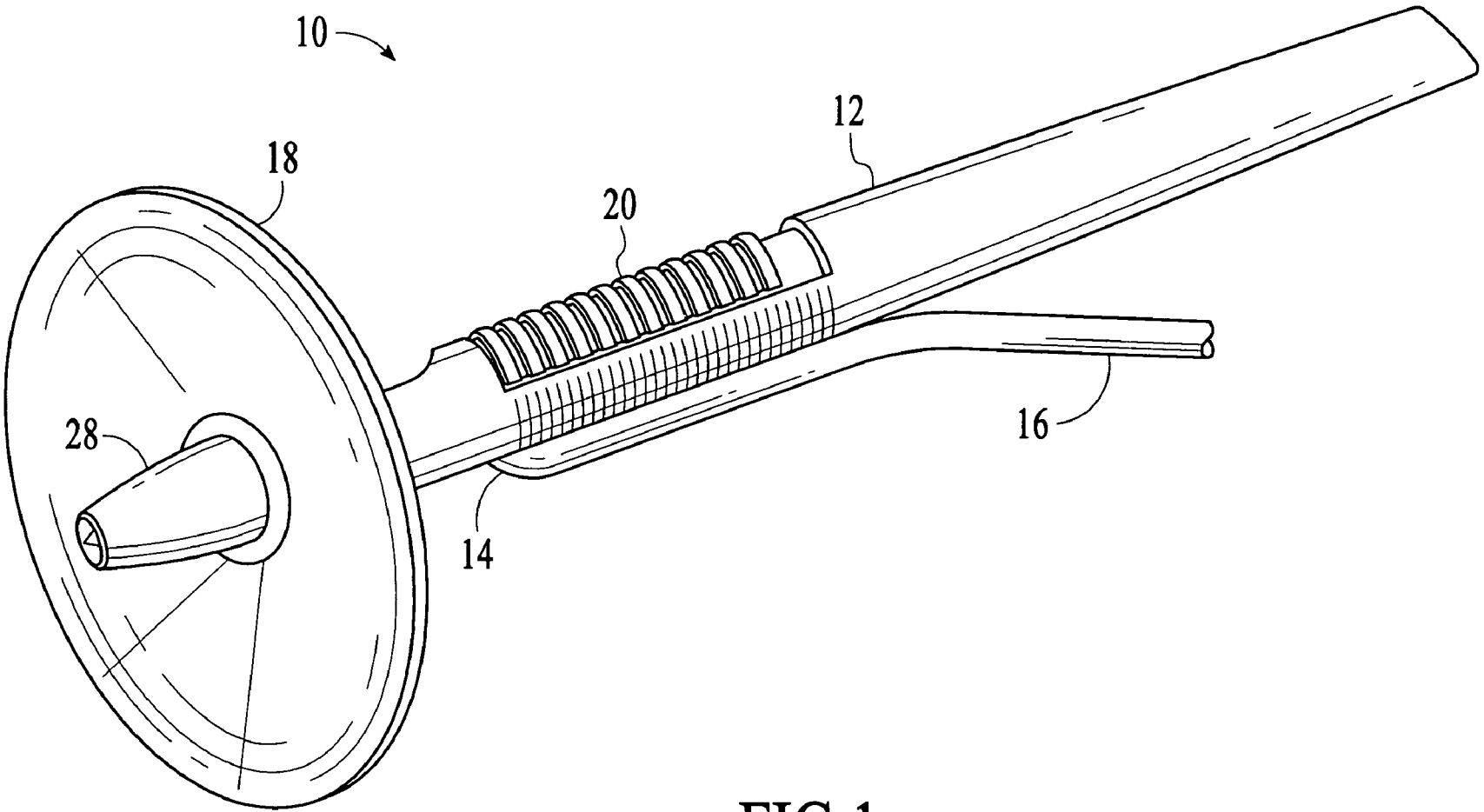
FIG. 1 is a perspective view of the airbrush spraying device of the present invention.

Referring first to FIG. 1, the present invention is an airbrush spraying device 10 particularly adapted for the application of beauty products. The airbrush 10 comprises a tubular main body 12 with a means for connection 14 to a pressurized air supply. The air supply connection means 14 is mounted not at the end of the main body 12, but rather on a bottom side behind a midpoint of the main body 12 due to ergonomic considerations. With the mid-body connection means 14, the air line 16 is draped over the user's wrist during operation. The support provided by the user's wrist helps to avoid misdirection of the airbrush and drag from the weight of the air line 16, and keeps the line 16 away from the intended application area, thereby protecting the makeup being applied. With the improved balance provided by the mid-body connection means 14, the airbrush 10 has a much "lighter" touch for the user.

A mirror 18 is mounted just behind the nozzle 28 on a front end of the airbrush 10. The mirror 18 allows the user to see the intended application area, while maintaining one hand operation of the airbrush 10. By not having to hold a mirror with his off hand, i.e. the hand not holding the airbrush 10, the user avoids entanglement with the air line 16, or interference with the movement of the airbrush 10. In the preferred embodiment, the mirror 18 is a magnifying mirror.

Figure 2:
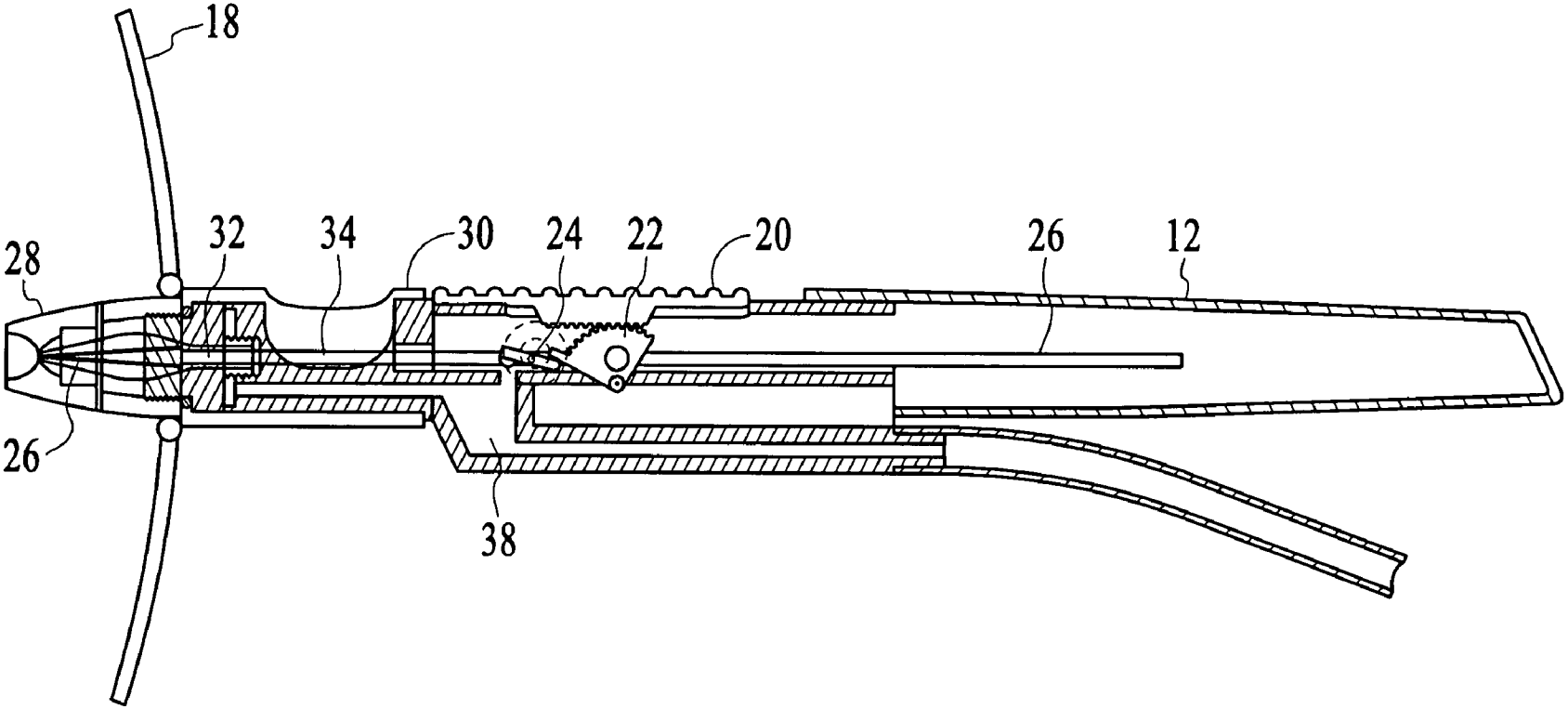
FIG. 2 is a sectional view of the airbrush.

With reference now chiefly to FIG. 2, a control switch 20 is located on a top side of the airbrush 10. The control switch 20 is a large tactile surface so that it can be easily manipulated by the user. The control switch will usually be operated by the index finger of the user. The control switch 20 is connected to a control mechanism 22. In the preferred embodiment, the control mechanism 22 is a rack and pinion assembly that is in communication with both an air pressure relief valve 24 and a makeup flow valve 26. The air valve 24 is an on/off mechanism, but the makeup flow valve 26 allows infinite variation of the makeup flow rate through the airbrush 10. The rack and pinion 22 provides a 4:1 step down in transferring motion from the control switch 20 to the makeup flow valve 26.

Figure 7:
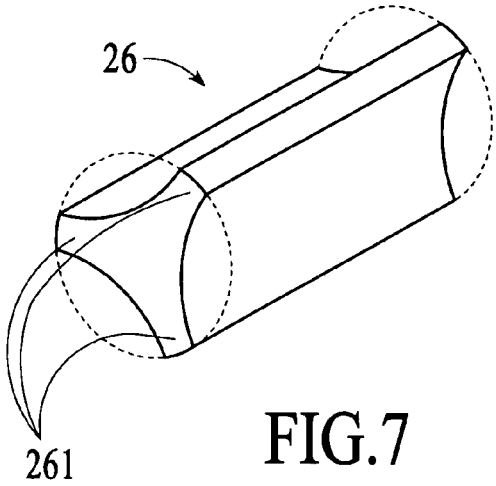
FIG. 7 is a perspective view of a middle portion of the fluted needle valve of the airbrush.
Figure 8:
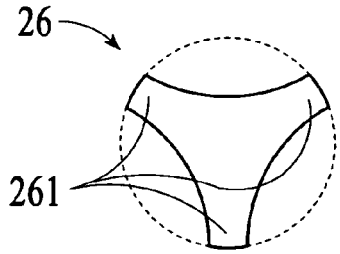
FIG. 8 is a sectional view of the fluted needle valve.
Figure 9:
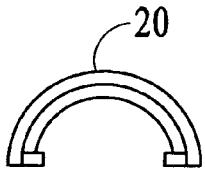
FIG. 9 is an end view of the control switch.
Figure 10:
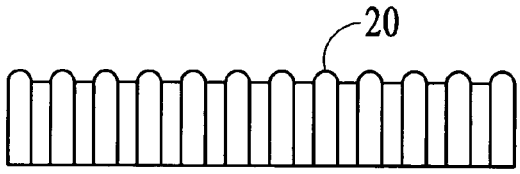
FIG. 10 is a side view of the control switch.

In the preferred embodiment, the makeup flow valve 26 is a fluted needle valve. The needle valve 26 is shown in detail in FIGS. 7 and 8. The flutes 261 of the valve taper to a point at the nozzle 28 of the airbrush 10. The flutes 261 allow the needle valve 26 to remain centered in the nozzle orifice 28 when the needle valve 26 is retracted from the closed position to open positions. The taper of the needle valve 26 allows the needle valve 26 to "self seat" in the nozzle. The flutes 261 are used to center the needle valve 26 in the needle valve passage between the reservoir 303 and the nozzle 28. The flutes 261 provide channels for the liquid makeup to flow form the reservoir 303 to the nozzle 28. The unique design of the needle valve 26 allows the airbrush 10 to be made from materials easier to work with and clean than the standard stainless steel valves used in the current art. The needle valve 26 can be constructed from plastics or TEFLON, which enables the valve 26 to be easily removed and cleaned, in a dishwasher if desired. The needle valve 26 will typically include a metallic rod inserted or molded into the center of the valve shaft to further straighten and center the nozzle 28.

Figure 3:
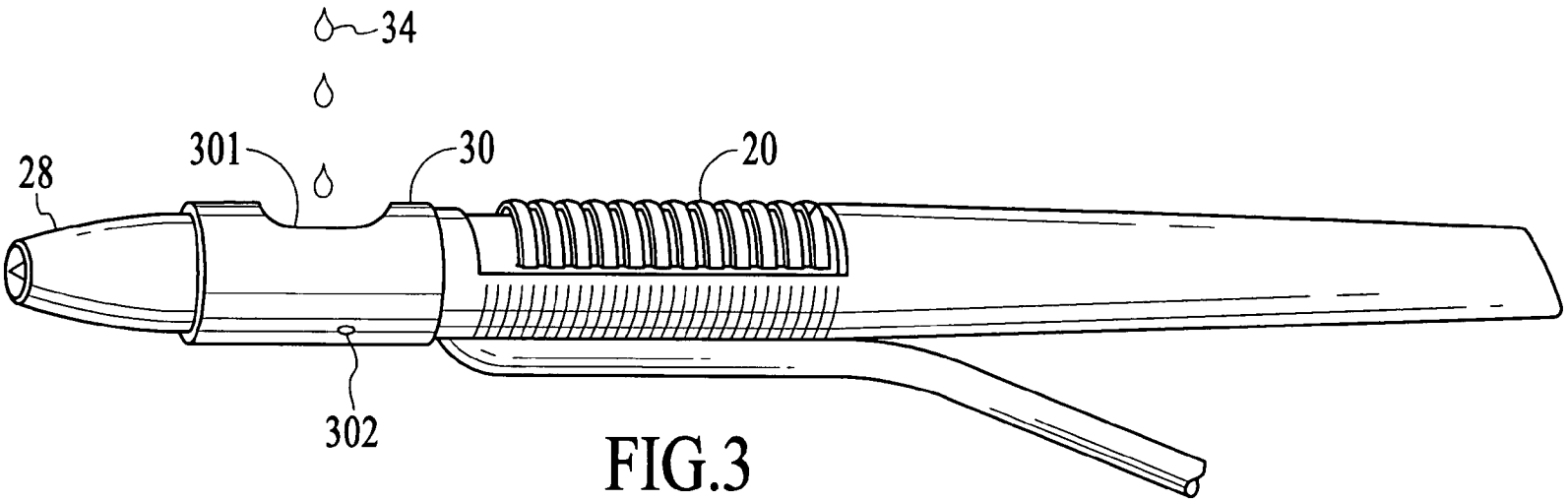
FIG. 3 is a perspective view showing the airbrush with a standard collar being filled with makeup.
Figure 4:
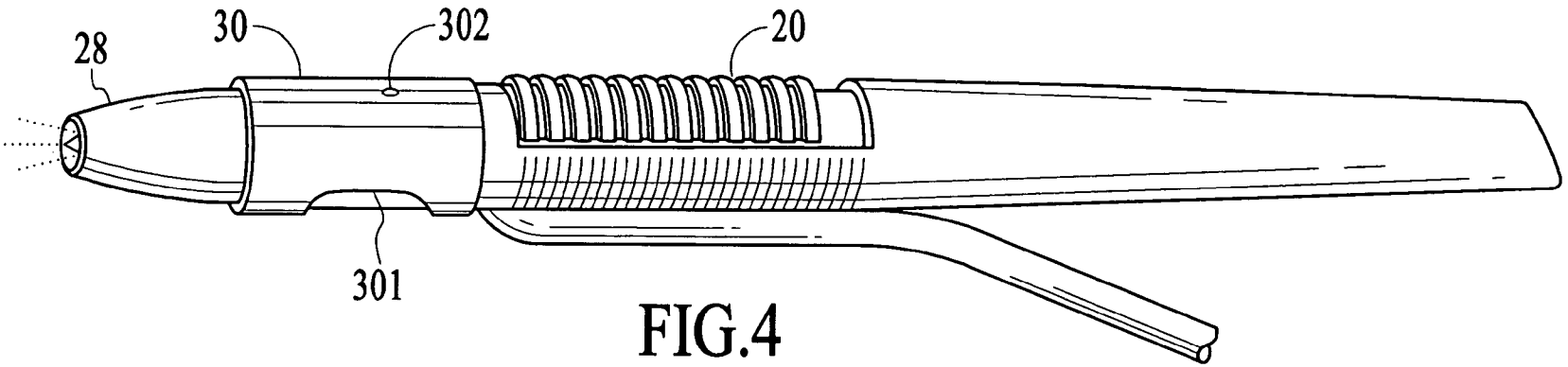
FIG. 4 is a perspective view showing the airbrush in a restricted flow position.
Figure 11:
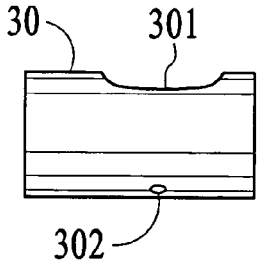
FIG. 11 is a side view of the standard collar.
Figure 12:
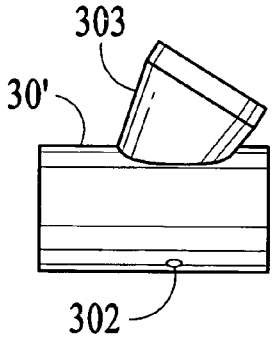
FIG. 12 is a side view of a cup collar.
Figure 13:
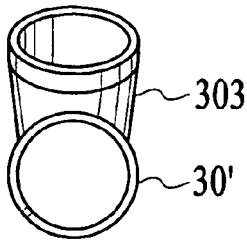
FIG. 13 is an end view of the cup collar.
Figure 14:
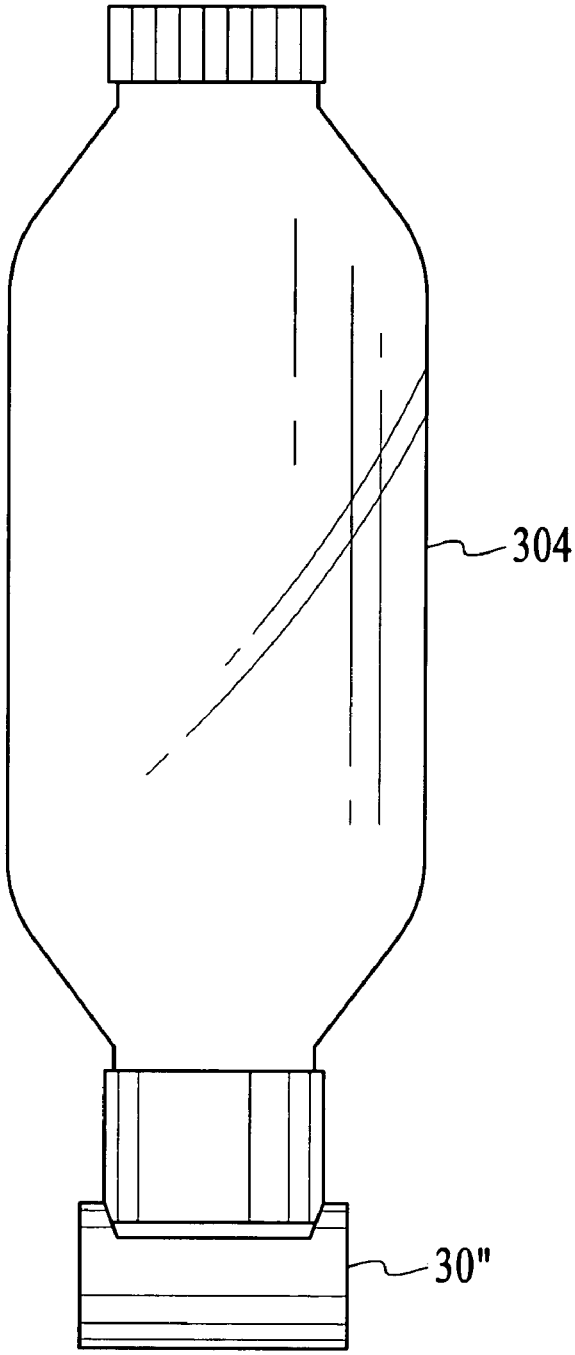
FIG. 14 is a side view of a bottle collar with a makeup bottle installed.
Figure 15:
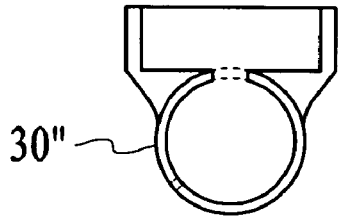
FIG. 15 is an end view of the bottle collar.

The makeup to be applied is supplied to the airbrush 10 from a makeup collar 30 that is rotatably affixed to the main body 12 of the airbrush 10. The standard collar 30 is illustrated in detail in FIGS. 11-13, and is shown installed on the airbrush 10 in FIGS. 2-4. FIGS. 3 and 4 illustrate the rotation of the collar 30. FIG. 3 shows the collar 30 in a fully open position. In this open position, the opening 301 of the collar 30 is aligned with the makeup channel 32 in the airbrush 10. The makeup 34 to be applied is inserted into the airbrush 10 through the opening 301 of the collar 30, where it passes through an opening in the makeup channel 32, and then out through the nozzle 28. If the makeup 34 is to be applied in a spot that requires the airbrush 10 to be at an odd angle (such as upside down), the airbrush 10 can be operated with the collar 30 rotated to the covered but vented position shown in FIG. 4, with the vent hole 302 aligned with the opening in the makeup channel 32. In the covered but vented position, even if the airbrush 10 is held upside down, the makeup 34 will not spill out of the collar 30. For travel or storage, the collar 30 is simply rotated to a closed solid cover sealed position where neither the opening 301 or the vent hole 302 is aligned with the makeup channel opening 321.

Often during use of the airbrush 10, the makeup 34 to be applied is body paint, and a relatively large volume is required. In this situation, a cup collar 30' with a reservoir 303 can be used. If an even greater volume of makeup 34 is desired, a bottle collar 30" with a detachable bottle 304 is utilized. All the collars 30, 30', 30" are interchangeable, and slide or snap onto the main body 12 of the airbrush 10.

Figure 5:
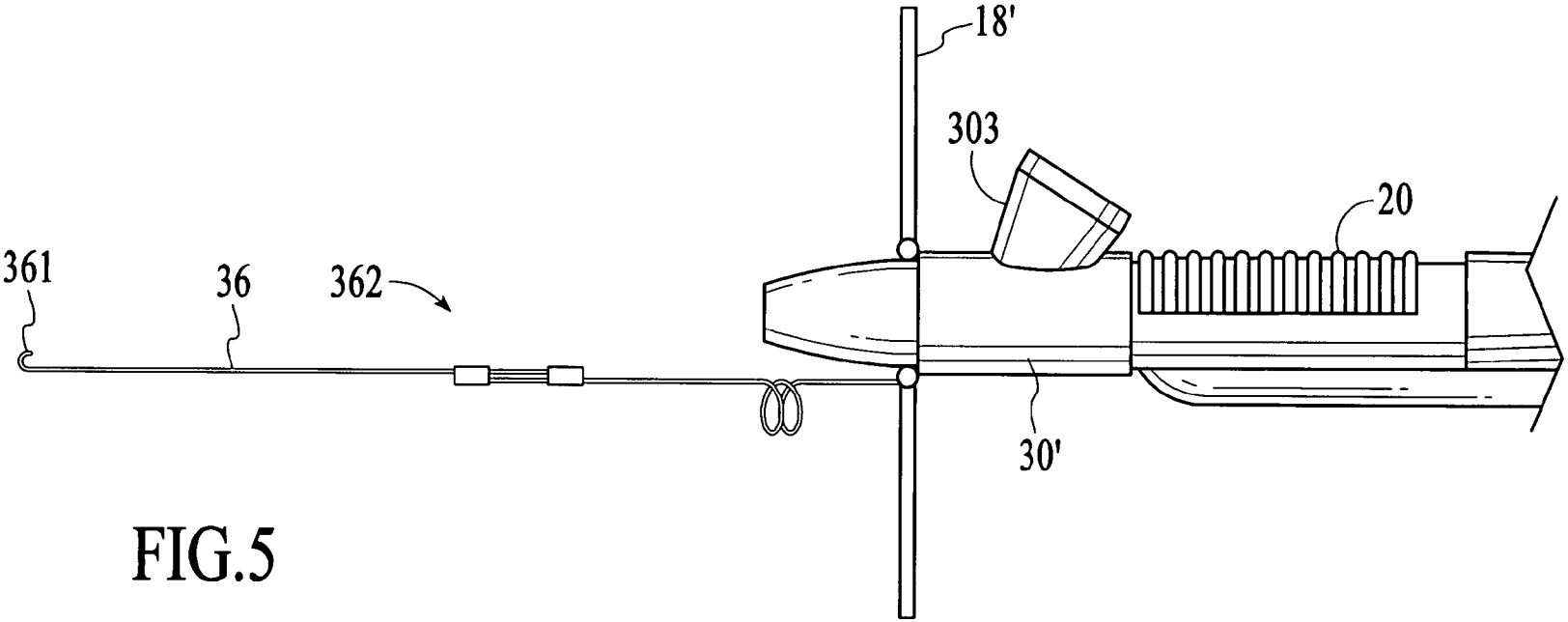
FIG. 5 is a side view showing the airbrush with a mirror and a standoff marker mounted on the front end thereof.
Figure 6:
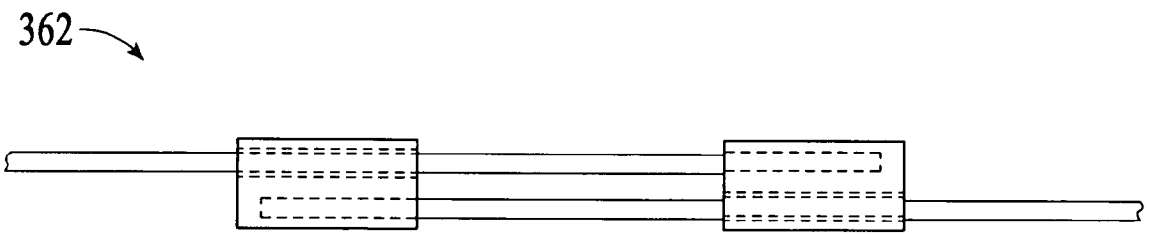
FIG. 6 is a side view showing an adjustable standoff marker.

Correct spacing of the airbrush 10 from the user can be critical to satisfactory application of makeup. To ensure that the user holds the airbrush 10 the proper distance, a standoff marker 36 (shown in FIG. 5) is affixed near a front end of the airbrush 10. The standoff marker 36 has a rounded front end 361 to ensure that contact with the user's person is not uncomfortable. The standoff marker 36 has a length adjustment means 362 to enable the user to change the measured spacing. In the preferred embodiment, the length adjustment means 362 is a slip joint as illustrated in FIG. 6.

Operation of the airbrush 10 is as follows: The user inserts makeup to be applied through the opening 301 in the collar 30. The airbrush 10 is connected to a compressed air source via the air line 16. When the user is ready to apply the makeup, he activates the control switch 20, thereby closing the air pressure release valve 24 and enabling the airbrush 10. The compressed air flows through an airway 38 in the main body 12 of the airbrush 10. As the user operates the control switch 20, the needle valve 26 is retracted from the nozzle 28, thereby opening the makeup channel 32. As air flows past the nozzle 28, a Venturi effect is created that causes a slight pressure differential at the collar 30. The suction created draws the makeup 34 to be applied through the nozzle 28.

As more or less makeup 34 is required, the user adjusts the position of the needle valve 26. When the makeup application is finished, the user returns the control switch 20 to its original position, closing the needle valve 26 and opening the air pressure release valve 24 to stop the flow of makeup and to release air pressure form the airbrush 10 and the air line 16.

Figure 16:
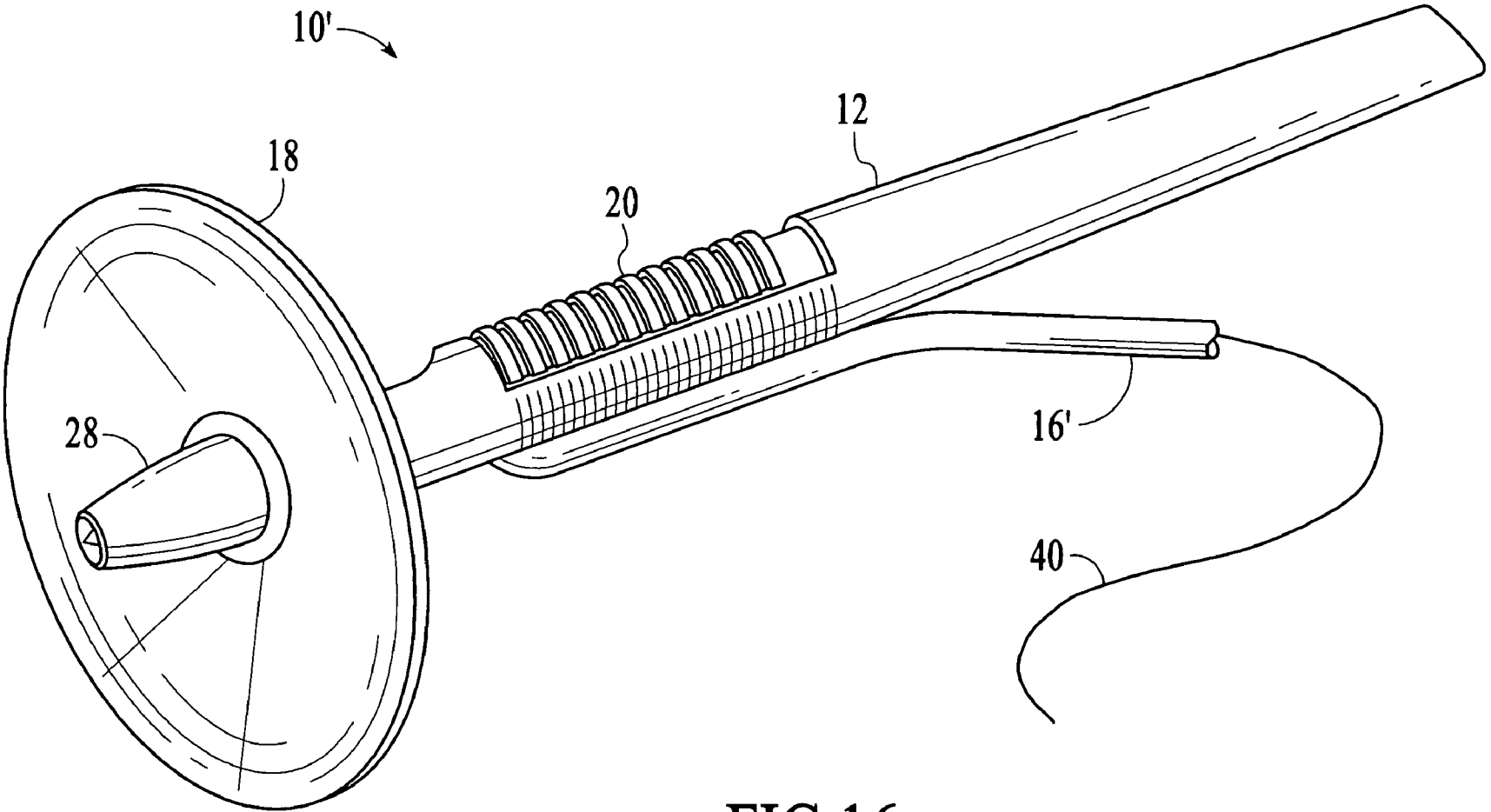
FIG. 16 is a perspective view showing the airbrush with a fiber optic strand included.

FIG. 16 illustrates an addition to improve visibility when using the airbrush 10. An optic fiber strand 40 is inserted into a dedicated channel in the air line 16'. The fiber optic strand 40 terminates near the nozzle 28 opening, thereby illuminating the area to be sprayed. The lighting means may be located in the main body 12 of the airbrush 10, or it may be mounted on the exterior.

The above disclosure is not intended as limiting. Those skilled in the art will recognize that numerous modifications and alterations may be made while retaining the teachings of the invention. Accordingly, the above disclosure should be construed as limited only by the restrictions of the appended claims.

I claim:

1. An airbrush spraying device comprising:

a tubular main body, an air line connection means adapted to receive an air line from a pressurized air supply, a control switch, a makeup input, and a nozzle situated at a front end of said main body; wherein when said control switch is activated with an initiating motion, an air pressure release valve is closed to provide air flow through said tubular main body, and said initiating motion simultaneously opens a makeup flow valve, a flow rate of makeup being infinitely adjustable by manipulation of said control switch, said makeup being pushed through said nozzle by air pressure, said manipulation of said control switch occurring within a range of motion that allows said air pressure release valve to remain closed, and said control switch being pushed to a closed position in which said air pressure release valve is opened and said makeup flow valve is closed when makeup application is complete.

2. The airbrush spraying device of claim 1 wherein:

said control switch is in communication with a control mechanism that provides a reverse mechanical advantage, a step down, in motion translated from said control switch to said makeup flow valve via said control mechanism.

3. The air spraying device of claim 1 wherein:

said air line connection means is situated at a central area of said main body, thereby allowing the air line to be supported by a hand and wrist of a user.

4. The airbrush spraying device of claim 1 wherein:

a mirror is affixed to said main body near a front end of said main body.

5. The airbrush spraying device of claim 1 wherein:

a lighting means is included with said airbrush spraying device to provide lighting to an intended application area.

6. The airbrush spraying device of claim 1 wherein:

a standoff marker is affixed to said main body to measure a desired distance of said airbrush from a surface to be sprayed.

7. The airbrush spraying device of claim 6 wherein:

said standoff marker comprises a length adjustment means.

8. The airbrush spraying device of claim 1 wherein:

said makeup flow valve is a fluted needle valve, flutes of said needle valve enabling said needle valve to remain centered in said main body when said needle valve is in an open position.

9. The airbrush spraying device of claim 1 wherein:

said makeup input comprises a plurality of collars.

10. The airbrush spraying device of claim 9 wherein:

each of said collars comprises a makeup reservoir, a vent hole, and an opening in communication with a makeup channel in said main body.

11. The airbrush spraying device of claim 9 wherein:

said collars are rotatable about said main body, said collars rotating between a fully open position in which an opening in said collar is aligned with an opening in a makeup channel in said main body, a covered but vented position in which a vent hole is aligned with said makeup channel, and a closed position.

12. An airbrush spraying device comprising:

a tubular main body, an air line connection means adapted to receive an air line from a pressurized air supply, a control switch, a makeup input, and a nozzle situated at a front end of said main body; wherein when said control switch is activated with an initiating motion, an air pressure release valve is closed to provide air flow through said tubular main body, and said initiating motion simultaneously opens a makeup flow valve, a flow rate of makeup being infinitely adjustable by manipulation of said control switch, said makeup being pushed through said nozzle by air pressure, said manipulation of said control switch occurring within a range of motion that allows said air pressure release valve to remain closed, said control switch being pushed to a closed position in which said air valve is opened and said makeup flow valve is closed when makeup application is complete, and said control switch is in communication with a control mechanism that provides a reverse mechanical advantage, a step down, in motion translated from said control switch to said makeup flow valve via said control mechanism.

13. The airbrush spraying device of claim 12 wherein:

said air line connection means is situated at a central area of said main body, thereby allowing the air line to be supported by a hand and wrist of a user.

14. The airbrush spraying device of claim 12 wherein:

a mirror is affixed to said main body near a front end of said main body.

15. The airbrush spraying device of claim 12 wherein:

a lighting means is included with said airbrush spraying device to provide lighting to an intended application area.

16. The airbrush spraying device of claim 12 wherein:

a standoff marker is affixed to said main body to measure a desired distance of said airbrush from a surface to be sprayed.

17. The airbrush spraying device of claim 16 wherein:

said standoff marker comprises a length adjustment means.

18. The airbrush spraying device of claim 12 wherein:

said makeup flow valve is a fluted needle valve, flutes of said needle valve enabling said needle valve to remain centered in said main body when said needle valve is in an open position, said flutes contacting walls of said main body.

19. The airbrush spraying device of claim 12 wherein:

said makeup input comprises a plurality of collars.

20. The airbrush spraying device of claim 12 wherein:

said collars are rotatable about said main body, said collars rotating between a fully open position in which an opening in said collar is aligned with an opening in a makeup channel in said main body, a covered but vented position in which a vent hole is aligned with said makeup channel, and a closed position.

* * * * *